United States Patent [19]

Stelte

[11] Patent Number: 4,458,827

[45] Date of Patent: Jul. 10, 1984

[54] METHOD TO METER ADHESIVE FOR ADHESIVELY COATING CHIPS, FIBERS AND THE LIKE FOR THE MANUFACTURE OF COMPOSITE PANELS, AS WELL AS APPARATUS TO CARRY OUT THE METHOD

[75] Inventor: Franz-Josef Stelte, Büren-Ahden, Fed. Rep. of Germany

[73] Assignee: Gebrüder Lödige Maschinenbau-Gesellschaft mit beschrankter Haftung, Paderborn, Fed. Rep. of Germany

[21] Appl. No.: 261,597

[22] Filed: May 7, 1981

[30] Foreign Application Priority Data

May 13, 1980 [DE] Fed. Rep. of Germany ..... 3018205

[51] Int. Cl.[3] ..... B67D 5/08

[52] U.S. Cl. ..... 222/1; 222/14; 222/63; 222/64; 222/136; 222/77; 222/318

[58] Field of Search ..... 222/52, 55, 57, 65, 222/135, 426, 428, 136, 16, 14, 15, 21, 22, 63, 64, 77, 318, 1

[56] References Cited

U.S. PATENT DOCUMENTS

| | | | |
|---|---|---|---|
| 2,951,618 | 9/1960 | Aldecoa | 222/318 X |
| 3,448,967 | 6/1969 | Seanor et al. | 222/57 X |
| 3,724,720 | 4/1973 | Bullivant | 222/63 X |
| 3,960,295 | 6/1976 | Horak | 222/21 X |
| 4,284,210 | 8/1981 | Horak | 222/14 |
| 4,353,482 | 10/1982 | Tomlinson et al. | 222/57 X |

*Primary Examiner*—Joseph J. Rolla

*Attorney, Agent, or Firm*—Frishauf, Holtz, Goodman & Woodward

[57] ABSTRACT

Two measuring cups (5, 6) are alternately filled and emptied. The fill state is determined by an overflow, and the emptying time during which a withdrawal pump (30) is connected to the respective cup is determined by scanning pump revolutions. The scanned pump revolutions for emptying are compared with a desired pumping rate, entered into a counter (50) which decrements in accordance with revolutions of the pump (30), and, if a deviation from commanded pumping rate is sensed, a correction memory (60) is loaded which controls over a control unit (33, 61) change in pumping speed to null any deviation from commanded rate. To associate the commanded rate with actual weight of chips or fibers to be coated, the chips or fibers can be weighed continuously, and the continuously weighed number entered into the control computer (33) to generate a command number for entry into the decrementing counter (50). Change-over of filling of the two cups is effected each time a "cup empty" signal is sensed by an appropriate fill state sensor (15, 16). The respective "cup empty" signals can also be used to effect re-calculation of pump rate for each withdrawal cycle.

15 Claims, 2 Drawing Figures

Figure 1:
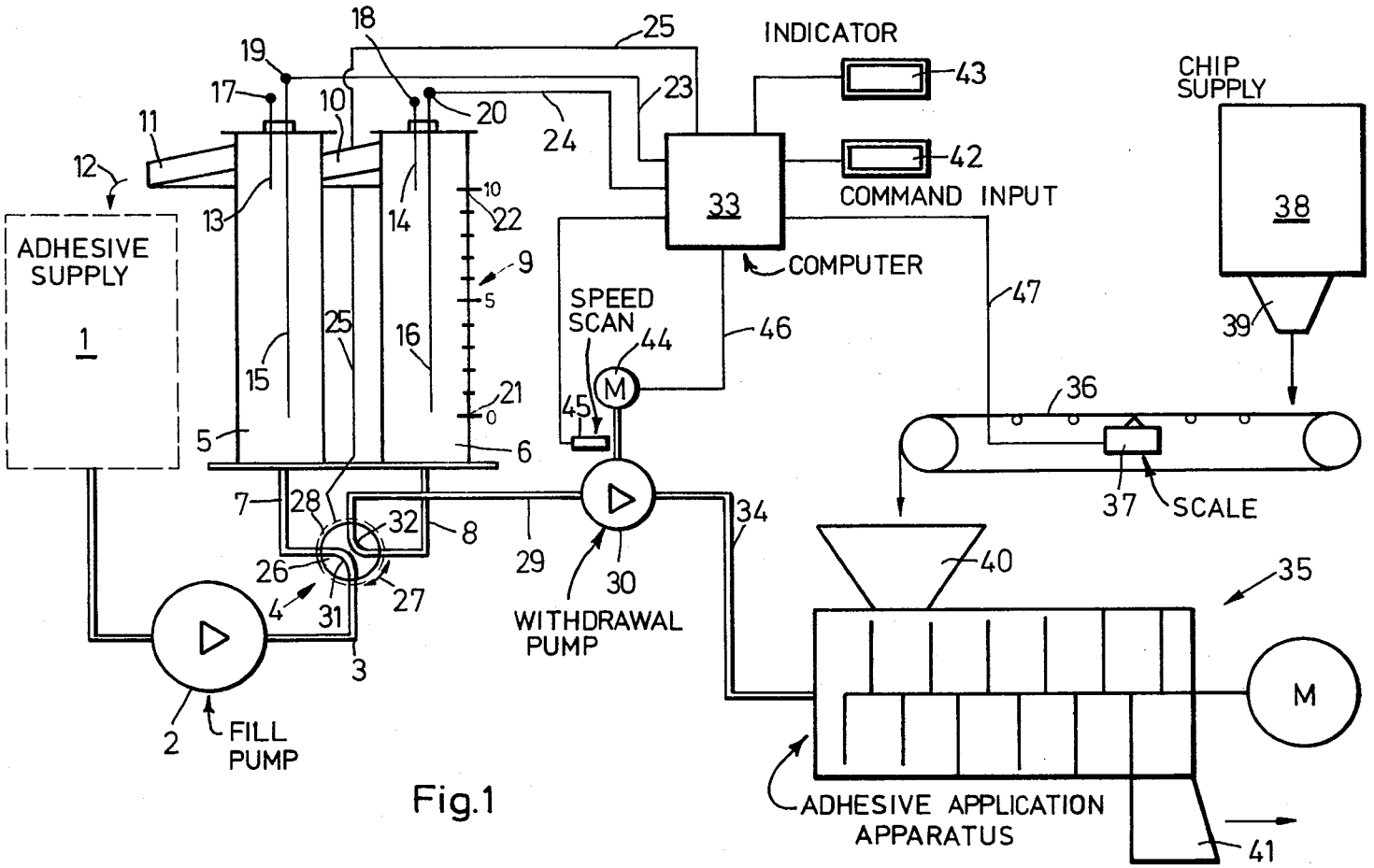

METHOD TO METER ADHESIVE FOR ADHESIVELY COATING CHIPS, FIBERS AND THE LIKE FOR THE MANUFACTURE OF COMPOSITE PANELS, AS WELL AS APPARATUS TO CARRY OUT THE METHOD

The invention relates to a method and to an apparatus to carry out the method to coat chips, fibers and the like with a flowable adhesive, so that the so-coated chips can then be made into composite panels.

BACKGROUND

It has been proposed to meter adhesive binder material by connecting a throughput meter in the supply line of a metering pump. The throughput meter can be in form of an oval wheel counter, a turbine wheel counter, or a displacement counter to determine the actual throughput of the adhesive. These counters require careful care and cleaning, since any deposition of adhesive or contamination of the metering device will erroneously influence the actually metered value supplied thereby. This disadvantage also affects inductive throughput measuring devices since they are also coupled to the medium in the supply line. Deposition of adhesive or contamination of the throughput metering devices results in erroneous metering and thus unavoidable operating disturbances in the overall plant.

THE INVENTION

It is an object to provide a method and apparatus to meter adhesives, independently of deposits and contaminations in the lines or the metering devices, to permit accurate metering of the adhesive.

Briefly, a pair of measuring cups are provided which are alternately filled and emptied. The emptying time is sensed by sensing the revolutions of a withdrawal pump, withdrawing adhesive from one of the measuring cups until a "cup empty" signal is obtained. The speed of the pump, or the emptying time, thus, provides a measure of the throughput flow, which is compared with a desired throughput flow and, if the comparison shows a difference, the speed of the pump is changed until the throughput flow as actually measured is equal to the desired throughput flow, thereby supplying a desired quantity of adhesive to chips, fibers, and the like, for subsequent processing.

The supply stream of adhesive is maintained in accurately metered form independently of deposits in the lines or the withdrawal pump rate. The cups, e.g. if made of transparent material, permit optical control of the supply quantity by the user. Changes in viscosity, pressure relationships or flow conditions during metering are compensated by the method of the invention. By metering with the cups, the actual value of the supply of adhesive by the pump can be continuously supervised. Larger or smaller measuring cups can be used in accordance with the desired throughput rate, or withdrawal volume, respectively, so that high accuracy can be obtained, in accordance with the individual operating requirements.

Throughput or flow meters of customary construction need not be used, so that the expensive maintenance of these apparatus is avoided. The user can employ pumps of any desired construction for the withdrawal pump, since the throughput of the pump is continuously monitored and readjusted.

In accordance with a feature of the invention, apparatus, to carry out the method, includes a suction connection of the withdrawal pump to the measuring cups, the measuring cups being filled from a standard filler pump to a level which, for example, is determined by an overflow. The withdrawal pump is connected to a controllable speed drive which, in turn, has its speed controlled by an electronic control circuit, for example of the computer type, which associates control output signals with predetermined comparison inputs, derived from a revolution sensor coupled to the pump for comparison with command input signals. The command input signals, initially, can be preset in accordance with a desired quantity of adhesive throughput or changed under control of actual weight of chips being applied to a continuous weighing system so that the throughput of the pump can be regulated in accordance with the actual mass of chips to be coated.

In accordance with a desirable feature of the invention, the command signal for operation of the pump, at a predetermined pumping rate, is stored in a correction memory which stores only deviation or correction values from a desired, commanded, or initially set pump rate and which, also, applies its output to the control unit to up-date or reset the value in which the then existing pump rate, effecting emptying of a respective cup, is always compared with the preceding one to permit storage only of correction factors with respect to preceding operating cycles.

Such an apparatus permits fully automatic control and metering.

Figure 2:
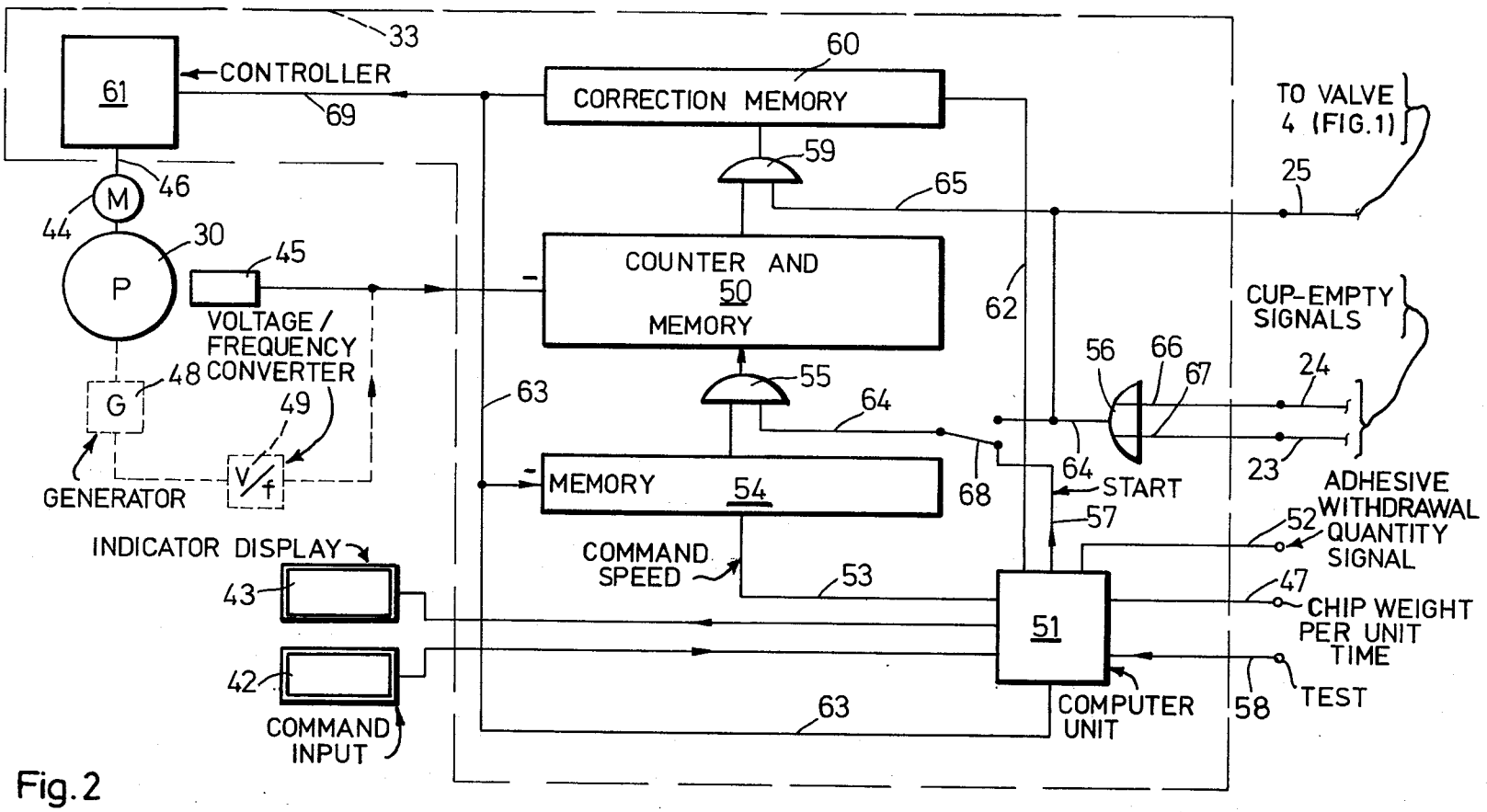

An embodiment of the apparatus of the invention is illustrated in the drawings and is described with more detail as follows:

There are shown in:

FIG. 1 an adhesive application arrangement for the manufacture of composite panels with the metering device in accordance with the invention, FIG. 2 a schematic block circuit diagram for electronic control of the metering apparatus according to FIG. 1.

FIG. 1 illustrates a supply container 1 which contains the adhesive to be metered. Adhesive, preferably glue, is supplied by a continuously pumping filler pump 2 from the supply container 1 over line 3 to a valve arrangement 4 which may consist of one or several valves, which conducts the glue, in dependence on the position thereof to one or the other measuring cups 5, 6, through lines 7, 8. The cups are preferably made of a transparent material, for example of glass, and provided with a measuring scale 9. The user thus has the opportunity to optically supervise the throughput of the metering device.

The scale 9 of the supply cups preferably has liter-subdivision. The cups 5, 6 have overflows 10, 11 in the height of the upper fillings level 22 which, upon overfilling, return the excess glue in the direction of the arrow 12 back to the supply container 1 in a manner no further shown. The filler pump 2 has a higher pumping capacity than a withdrawal pump 30 so that the measuring cups 5, 6 are filled by the filler pump more rapidly than they can be emptied by the withdrawal pump 30. Consequently, the glue is continuously circulated in a loop.

Electrodes 13, 14, 15, 16 are located approximately in the center of the cups which scan the minimum and maximum filling state 21, 22 of the measuring cups 5, 6 and provide a signal at their output terminals 17 to 20.

The terminals 19, 20 which provide a signal when the cups have the minimum fill level 21 are connected with an electronic control device 33 to which the signals from the terminals 19, 20 are supplied over line 23, 24. The terminals 17, 18 provide signals when the cups have their maximum fill level. A control line 25 controls an operating element, not shown, of the valve device 4 which, upon each signal on the control line 25 rotates the valve body 26 of the valve device 4 in the plane of the drawings by a quarter revolution, that is, by about 90° in the direction of the arrow 27. The revolution can be sequentially carried out in one direction. It is also possible to rock the valve body 26 by about 90° back and forth.

The lines 31, 32 which are bent over at 90° connect, in the position of the valve body 26 as shown, the supply line 3 with the line 7 of the measuring cup 5 and the line 8 with the suction connection 29 of the withdrawal pump 30.

In this position, the measuring cup 5 is filled by the filler pump 2, the measuring cup 6 is emptied by the withdrawal pump 30. When the measuring cup 6 reaches its minimum fill level 21, the electrode 16 provides a signal, the electronic control device 33 operates the valve arrangement 4 over control line 25 and the valve body 26 is almost instantaneously rotated by 90°. During operation of the valve device 4, both pumps 2 and 30 continue to pump, so that thereafter the measuring cup 6 is filled by the filler pump 2 whereas the withdrawal pump 30 pumps from the measuring cup 5. The changeover of the valve element 26 is so rapid that no interruption in supply in the line 34 occurs which supplies the glue to the glue application machine 35.

The glue application machine 35 receives the chips to be glue-coated from a supply silo 38 with a discharge device 39. Due to a control, not shown, the chips are applied with an essentially constant flow rate of the same volume. The flow rate of the chips is transferred to an electrical signal by means of a measuring device, preferably a continuous scale 37 or a suitable continuous flow measuring device, respectively, which is applied over a line 47 to an electronic control device or a computer 33. At the end of the conveyor 36, the chips fall through a hopper 40 in the glue application device 35 and is wetted by the glue applied over line 34. The glue coated chips are withdrawn for further processing over an output device 41.

The desired or commanded chip/adhesive relationship is set into an input unit 42 connected with the control unit 33. An indicator 43 indicates, in operation of the device, the then pertaining throughput of the withdrawal pump 30 in adhesive quantity per unit time.

The withdrawal pump 30 is driven by a motor 44. The then pertaining rotary speed of the withdrawal pump 30 is sensed by a scanning device 45 and applied to the control device 33 in form of a frequency proportional to speed.

The speed of the withdrawal pump 30 is controllable by controlling the speed of the motor 44 over the control line 46. Preferably, the motor 44 is a direct current motor, since it can be directly controlled. Embodiments utilizing three phase motors are conceivable, in which the drive shaft is speed variable, for example, over a speed change transmission.

The operation of the device is described by reference to FIG. 2.

The frequency signal proportional to the speed of the withdrawal pump is applied to the input of a down counter 50. A contactless scanning device 45 is preferably provided to generate the frequency signal which scans, inductively, capacitatively, or optically synchronous markers rotating with the drive shaft of the withdrawal pump 30.

In another embodiment, drawn in broken lines, the withdrawal pump 30 drives a generator 48, the voltage of which depends on the speed of the pump 30 and is transformed into a corresponding frequency by a voltage/frequency transducer 49.

A computer unit 51 has the desired adhesive/chip relationship entered therein over the input unit 42. The computer unit receives a signal over line 47 which corresponds to the quantity of the chips supplied to the hopper 40, for example in weight per unit time. The computer unit 51 determines the required quantity of adhesive per unit time for the commanded relationship and determines the required speed of the withdrawal pump 30 for such computation. The data required therefore, for example the performance characteristics of the withdrawal pump can be supplied to the computer unit 51 by means of a memory, not shown. In the same manner, the fixed commanded withdrawal quantity from the supply cups can be signalled to the computer unit; preferably, however, the computer unit 51 will receive the then pertaining set withdrawal quantity from the supply cups 5, 6 over line 52. This has the advantage that, for example, by change of the height level position of the electrodes 15, 16 the withdrawal quantity from the cups can be changed. It is also possible in this manner to use measuring cups of different diameter and shape.

The computer unit 51 determines from these data the speed of the withdrawal pump 30 which is necessary to empty one of the measuring cups 5, 6. This command speed is transferred, for example, as a binary word over the line 53 to a memory 54. This number represented as a binary word is applied over an AND gate 55 to the counter 50 which functions also as a counter-and-memory 50 receives the binary command word always at that time when the OR gate 56 provides an output signal. The counter 50 counts down in synchronism with pump revolutions, thus effecting a comparison between commanded and actual withdrawal. The OR gate 56 generates an output signal when a signal is applied to one of its inputs 66 to 67. The inputs 66, 67 are connected over lines 23, 24 with the minimum level electrodes 15, 16 of the measuring cups 5, 6 and receive, each, a signal when a cup is empty. The output signal of the OR gate 56 is supplied over line 25 to operate the valve device 4, already described, as well as to switch a further AND gate 59. The output signal of the counter 50 is applied to a second input of the AND gate 59 which represents the then-pertaining count state and which is transferred upon an output pulse from OR gate 56 to the correction memory 60. The output signal of the correction memory 60 is applied over line 69 to the electric controller 61 which, in dependence on the value in the correction memory 60 provides an output signal to the control line 46 which changes the speed of the withdrawal pump 30. An indicator 43 indicates the instantaneous volume flow per unit time to monitor the apparatus. The output signal of the correction memory 60 is also supplied to the memory 54 over a line 63 where it is added or subtracted, respectively, from the then pertaining storage state considering mathematical rules.

Upon starting the system, the fill pump 2 fills one of the two measuring cups, 5, 6, in accordance with the then pertaining position of the valve device 4. When the measuring cup is filled, which is monitored by the electrodes 13, 14, the withdrawal pump 30 and the electronic control device 33 is started, and chips are supplied to the adhesive application apparatus. The computer 51 determines, based on the then pertaining and set-in data 42 the necessary command revolutions of the withdrawal pump 30 to empty one of the cups 5, 6 within a predetermined time, which is determined by the commanded relationship of volume/time. The command revolution in the predetermined time determine the time speed of the withdrawal pump. A start signal on line 57 is supplied by a switch 68 whereupon the command revolutions are transferred to the counter 50. The switch 68 permits operation of the measuring device with, or without, computer correction. Due to the output signal on line 64, a pulse is applied to the control line 25 so that the full cup 5, or 6 respectively is connected to the suction line 29 of the withdrawal pump 30 and the volume of the adhesive in the measuring cup is supplied to the adhesive application apparatus 35. Each revolution of the withdrawal pump 30 is transmitted to the counter 50 and subtracted from the instantaneous counter state. When the measuring cup 5, 6, respectively, is empty, the electrodes 15, 16, respectively supply over line 23, 24, respectively, a pulse to the OR gate 56. This output signal then, connects the other measuring cup 5, 6, which has been filled in the meanwhile, to the suction line 29 of the pump. The AND gates 55, 59 are enabled with the output signal of the OR gate 56 and the existing counter state is transferred to the correction memory 60 and the respective command value in the memory 54 is again entered into the counter 50.

If the withdrawal pump 30 operates perfectly and if all lines 7, 8, 29, 31, 32, 34 are free from deposits, then the counter state of the counter 50 upon transfer into the correction memory 60 will be exactly 0, since the memory initial value corresponded to the sum of the command revolutions which were precalculated by the computer unit 51. If the withdrawal pump has an excessive throughput, then the counter state of the counter 50 upon transfer to the correction memory 60 will be greater than 0, since less revolutions were necessary to empty the measuring cups 5, 6. The value of the correction memory 60 is negatively superimposed over the contents of the memory 54 over line 63, so that, upon the next transfer cycle by a pulse from the OR gate 56 the value taken over into the counter 50 will be smaller. Simultaneously, the output signal of the correction element 60 is supplied to an electrical controller 61 which thereupon changes the control signal for the motor 44 so that its speed, and with it the speed of the withdrawal pump will be less. The pumping throughout of the withdrawal pump 30 thus is matched to the desired pumping throughput, which is determined by the mixing ratio entered by the command input 42.

If the throughput of the pump 30 becomes less, then the count content of the counter 50 will be negative when a measuring cup is emptied. Corresponding to this value, the speed is increased by the means of the electronic controller 61 and the content of the correction memory is added into the memory 54.

In order to obtain immediate change of the memory content of the correction memory 60 upon change of setting of the proportionality, the content of the computer unit 51 can be proportionately changed over the line 62. The value of the memory content is hereby applied over line 63 to the computer unit 61. An immediate change of the control signal on the line 46 will result, as well as a change of the memory content of the memory 54.

Threshold switches may be provided in accordance with an advantageous further development of the device in accordance with the invention which are operated at the predetermined value of the content of the correction memory 60 and generate a signal which indicates malfunction of the system, or, respectively, recommends cleaning of the system. No errors can occur in such a measuring device due to tolerances in the supply throughput of withdrawal pumps of the same constructional type, since the theoretical supply throughput of the pump is not used for monitoring of the supply flow, but rather, the measuring arrangement "recalibrates" the withdrawal pump based on its actual throughput in the measuring device while considering all secondary influences after each emptying of a measuring cup. The speed of the withdrawal pump which is set based on a commanded throughput is recontrolled by supervision of the throughput, so that a once set throughput is maintained by change in speed. Depending on use and desires of the user, such a measuring device can maintain a very accurate throughput by choice of small measuring cups, so that deviations from the throughput can be predetermined and can be made dependent on permitted deviations.

A test value can be introduced over line 58 to the computer unit so that supervision of the overall apparatus is possible.

The output terminal 17, 18 of the electrodes 13, 14, may also be used to provide a supervisory device regarding filling of the measuring cups.

Further, the system can be optically controlled by the user by comparing the emptying time of a measuring cup and the thereby resulting throughput rate with the commanded throughput rate.

The measuring device permits the use of spiral and gear pumps or the like; also, the use of positioning valves in the supply line of a measuring pump is possible.

By use of measuring cups, exact recording of the adhesive consumption is possible without requirement of a complicated back calculation. Such sensing of real quantities could be carried out for example by means of output signals from terminals 17 to 20.

The measuring cups which have a constant withdrawal level between the markers 21, 22 (FIG. 1) are preferably calibrated in values based on ten, or hundred subdivisions, so that a simple counter can be controlled with the output signals therefrom so that the indicator has to be multiplied only with a corresponding factor.

The signal lines shown in FIG. 2 are indicated only schematically, for example, the transfer of a binary word is preferably carried out in parallel in order to save time and to avoid the need for unnecessary conversion electronics which is needed for serial transfer.

Rather than using an exact sequence of steps to start the measuring device it is also possible, for example, to block the output of the correction memory in the starting cycle in order to inhibit undesired control steps. For starting, the commanded speed which is based on the theoretical speed, and thus the desired throughput is sufficiently accurate.

I claim:

1. Method of metering of adhesives for application thereof to chips, fibers and the like for manufacture of composite panels, said adhesive being metered by an apparatus having a supply vessel (1) to supply adhesive, a widthdrawal pump (30) to supply adhesive to an adhesive application apparatus (35), and control means (33, 44, 45, 46) to control the speed of operation of the withdrawal pump, comprising the steps of filling a first measuring cup (e.g. 5) of two cups (5, 6) over a supply line (3) with adhesive while simultaneously connecting a second measuring cup (e.g. 6) of the two cups with a suction connection (29) of the withdrawal pump (30);

storing the performance characteristics of the withdrawal pump (30);

sensing emptying of the second cup by the withdrawal pump by sensing the number of revolutions of the withdrawal pump during the actual emptying time;

then simultaneously effecting a connection between the supply line (3) and the second measuring cup (6) and connecting the first measuring cup to the suction connection (29);

then continuing sensing the actual emptying time of the respective measuring cups;

comparing the actual emptying measuring time with a command emptying time which is determined based on the desired volume of adhesive per unit time being supplied by the withdrawal pump including comparing the actual revolutions with the number of command revolutions of the pumps, said command revolutions being based on the stored performance characteristic data of the withdrawal pump;

and controlling the throughput rate of the withdrawal pump (30) as a function of the difference between the actual and commanded emptying time by increasing, upon exceeding the command revolutions, the rotary speed of the withdrawal pump and of a stored number of the command revolutions for subsequent comparison, and decreasing, upon falling below the command revolutions, the rotary speed of the withdrawal pump and decreasing the stored number of command revolutions for subsequent comparison, the stored number of command revolutions being incremented or decremented, respectively, by the amount of the difference of the comparison.

2. Method according to claim 1, further including the step of applying a signal proportional to the quantity of chips, fibers and the like to be coated to the control means as a guide number for the command emptying time.

3. Method according to claim 1, further comprising the step of deriving the command time as a function of a predetermined proportion between chips, fibers and the like and adhesive.

4. Method according to claim 1, wherein said sensing step comprises generating a "cup empty" signal upon termination of emptying of a cup, which forms a start or stop signal, respectively, for measuring the emptying time, and controlling a change-over valve (4) in the supply line (3) between said measuring cups (5, 6) and the adhesive supply (1) as a function of said "cup empty" signal, and controlling a change-over valve connection to transfer the suction connection (29) of the withdrawal pump to a full measuring cup (5, 6).

5. Method according to claim 1, wherein the step of sensing the emptying of a cup includes deriving a "cup empty" signal and including the steps of computing the number of desired revolutions of the withdrawal pump to empty a measuring cup and transferring said number as a desired or actual revolution number to a buffer memory (54);

transferring the memory state of the buffer memory (54) to a counter (50);

sensing the actual revolutions of the withdrawal pump (30) and deriving actual pump revolution signals;

applying the actual pump revolution signals to the counter (50) and decrementing said counter upon each revolution of the withdrawal pump by at least one count unit;

transferring the counter state upon each "cup empty" signal to a correction memory (60);

and wherein the controlling step includes increasing, or decreasing, or holding constant the speed of a motor (44) driving the withdrawal pump (30) in accordance with the value in the correction memory;

and further including the step of modifying, with proper sign, the content of the buffer memory (54) by the value of the correction memory.

6. Method according to claim 1, including the step of sensing the actual revolutions of the withdrawal pump (30) and deriving actual pump revolution signals in the form of a multiple of pulses for each revolution of the withdrawal pump;

and the controlling step comprises comparing said number of pulses with a commanded value of pump command revolutions increased by a factor corresponding to said multiple.

7. Method of metering adhesives being supplied from a supply vessel (1) to a utilization station (35), particularly for coating of chips, fibers and the like with adhesives for processing thereof to make composite panels or the like and having a withdrawal pump (30);

a speed controllable drive motor (44) connected to the supply pump;

and a control system to control the speed of the motor and hence of the pump, comprising the steps of storing the performance characteristics of the withdrawal pump (30);

(a) providing two measuring or metering cups (5, 6) of predetermined volume;

(b) providing a supply connection from the supply vessel (1), selectively, to one of the measuring cups;

(c) filling a first one (5) of the measuring cups with adhesive from the supply vessel;

(d) withdrawing adhesive from said filled first cup by operation of the withdrawal pump and determining when said first one metering cup has reached a predetermined empty state and providing a "cup empty" signal and sensing the number of revolutions of the withdrawal pump during the actual emptying time;

(e) filling the second one (6) of the metering cups while emptying the filled first cup (5);

(f) determining elapsed time between commencement of withdrawal of adhesive by the withdrawal pump and occurrence of the "cup empty" signal to derive an actual measured quantity withdrawal time signal;

(g) providing a command withdrawal time signal;

(h) comparing the command withdrawal time signal and the actual withdrawal time signal and deriving a deviation signal by comparing the actual revolutions with the number of command revolutions of the pumps, said command revolutions being based on the stored performance characteristic data of the withdrawal pump;

(i) controlling the speed of the motor of the withdrawal pump as a function of the deviation signal by increasing, upon exceeding the command revolutions, the rotary speed of the withdrawal pump and of a stored number of the command revolutions for subsequent comparison, and decreasing, upon falling below the command revolutions, the rotary speed of the withdrawal pump and decreasing the stored number of command revolutions for subsequent comparison, the stored number of command revolutions being incremented or decremented, respectively, by the amount of the difference of the comparison.

8. Method according to claim 7, wherein the step of terminating the filling of the first measuring cup (5) and filling of the second measuring cup (6) comprises changing-over a supply connection (3) from the supply vessel (1) between said measuring cups.

9. Apparatus for metering of adhesives for application thereof to chips, fibers and the like for the manufacture of composite panels having a supply vessel for the adhesive (1);

a withdrawal pump (30) and a suction connection (29) thereto, said withdrawal pump supplying adhesive to a utilization station (35) for coating said chips, fibers and the like;

two measuring cups (5, 6) having predetermined fill capacity;

valve means (4) selectively, alternately connecting the supply vessel to one (5) of said cups and the suction line (29) of the withdrawal pump to the other (6) of the cups;

"cup empty" sensors (15, 16) positioned to sense the fill state of the cups and providing "cup empty" signals;

a variable speed drive (44) coupled to the withdrawal pump;

pump revolution scanning means (45) coupled to the pump and providing pump speed signals representative of the revolutions of the pump;

and variable speed drive control means (33) coupled to the pump revolution sensing means, controlling the speed of operation of said pump, and further coupled to the "cup empty" sensors (15, 16), said control means including a computer (51);

means (42, 47) entering into the computer a command input value representative of a given throughput of adhesive with respect to a given weight or mass of chips or fibers to be coated;

said computer storing the performance characteristics of the pump and providing pump operating data in the form of binary representation;

a buffer memory (54) representative of pump throughput for a desired coating;

a counter (50) receiving the output from said buffer memory and said pump speed signals and comparing said pump speed scanning signals from the pump revolution scanning means (45) with the pump operating data to provide a deviation signal if the throughput of the pump, for emptying of a cup, deviates from a predetermined value as stored in the buffer memory representative of desired coating of the chips or fibers for comparing the commanded throughput of the pump with the time duration between succeeding "cup empty" signals derived from the "cup empty" sensors (15, 16) for control of the variable speed dirve (44) at a speed at which the interval between succeeding "cup empty" signals will be as determined by said command input;

control connection means (25) between said control means (33) and said valve means (4) to effect change-over of the selective connection of the valve means each time the "cup empty" sensors (15, 16) furnish a "cup empty" signal; and a correction means (60, 61) connected to receive data representative of said deviation from the counter, the correction means controlling said variable speed drive (44) to change the speed of the pump in a direction to null said deviation, said correction means comprising a correction memory (60) connected to an electrical control unit (61), said electrical control unit controlling the speed of said variable speed drive, and said correction memory storing data representative of a deviation of pump throughput from desired pump throughput, said correction memory being connected to said computer unit to change the value in the buffer memory (54) representative of desired pump speed for application to the down-counter (50) upon a subsequent emptying cycle of said cups.

10. Apparatus according to claim 9, wherein said counter is a down-counter having a count input connected to the pump revolution scanning means (45) and having a data entry input connected to receive the desired or commanded pump operating data from said buffer memory (54).

11. Apparatus according to claim 9, further comprising a filler pump (2) connected between the adhesive supply and said valve means selectively connected to fill said cups (5, 6), said filler pump having a pumping capacity which is greater than that of the withdrawal pump (30);

and overflow means (11) collecting overflow adhesive from said cups and returning said adhesive to said adhesive supply.

12. Apparatus according to claim 9, wherein said measuring cups (5, 6) are made of transparent material to permit visual checking of the filling state thereof.

13. Apparatus according to claim 9, further comprising a chip or fiber weighing scale (36-39) providing a command input to said computer means (33) as a function of actual weight or mass of chips to be coated by the adhesive and to control the variable speed drive as a function of said actual mass or weight.

14. Apparatus according to claim 9, further comprising connection means (23, 24; 56) to said computer from the "cup empty" sensors (15, 16) and controlling transfer of data from the buffer memory (54) to the down-counter (50) and deviation data from the down counter (50) to the correction means (60).

15. Apparatus according to claim 14, further comprising a connection line (62, 63) between the correction memory (60) and said computer (51) to mutually affect the value assigned to the pump operating data within the computer, and the value entered into the correction memory (60) as a function of data entered into the computer.

* * * * *